US011969616B2

(12) United States Patent
Liu et al.

(10) Patent No.: US 11,969,616 B2
(45) Date of Patent: Apr. 30, 2024

(54) STRENGTH TRAINING EQUIPMENT

(71) Applicant: Huizhou Xing Wei Intelligent Technology Co., Ltd., Huizhou (CN)

(72) Inventors: Hongjun Liu, Huizhou (CN); Zhaohui Wang, Huizhou (CN)

(73) Assignee: Huizhou Xing Wei Intelligent Technology Co., Ltd., Huizhou (CN)

( * ) Notice: Subject to any disclaimer, the term of this patent is extended or adjusted under 35 U.S.C. 154(b) by 120 days.

(21) Appl. No.: 17/710,730

(22) Filed: Mar. 31, 2022

(65) Prior Publication Data

US 2023/0166150 A1 Jun. 1, 2023

(30) Foreign Application Priority Data

Nov. 30, 2021 (CN) ..... 202111449344.7

(51) Int. Cl.
*A63B 21/005* (2006.01)
*A63B 21/00* (2006.01)

(52) U.S. Cl.
CPC .... *A63B 21/0058* (2013.01); *A63B 21/00076* (2013.01)

(58) Field of Classification Search
CPC ..... A63B 21/0058; A63B 21/00076; A63B 24/0087; A63B 21/153; A63B 21/15; A63B 2071/027; A63B 2208/0204; A63B 23/00
See application file for complete search history.

(56) References Cited

U.S. PATENT DOCUMENTS

| | | | | |
|---|---|---|---|---|
| 10,617,903 | B2 * | 4/2020 | Orady | A63B 23/12 |
| 11,285,355 | B1 * | 3/2022 | Nicholson | A63B 21/15 |
| 2018/0021616 | A1 * | 1/2018 | Orady | A63B 21/153 482/5 |
| 2019/0099633 | A1 * | 4/2019 | Orady | A63B 21/0058 |
| 2022/0184452 | A1 * | 6/2022 | Valente | A63B 21/0058 |
| 2022/0339481 | A1 * | 10/2022 | Peal | A63B 21/169 |

* cited by examiner

*Primary Examiner* — Andrew S Lo
(74) *Attorney, Agent, or Firm* — Jeenam Park

(57) ABSTRACT

The disclosure discloses a strength training equipment. The strength training equipment includes a speed changing device, which includes a driving motor and a speed changer, wherein the speed changer outputs the output of the driving motor after speed reduction; a differential mechanism, which is provided with a first output shaft and a second output shaft and can convert the output after speed changing by the speed changer into asymmetric force to be output from the first output shaft and the second output shaft; and a take-up device, which includes two take-up boxes which are connected with the first output shaft and the second output shaft respectively.

10 Claims, 11 Drawing Sheets

STRENGTH TRAINING EQUIPMENT

CROSS-REFERENCE TO RELATED APPLICATIONS

The present disclosure claims priority to Chinese Patent Application No. 202111449344.7 filed on Nov. 30, 2021, the content of which is incorporated herein by reference in its entirety.

TECHNICAL FIELD

The disclosure relates to sports equipment, in particular to strength training equipment.

BACKGROUND

Strength training equipment is mostly a heavy mechanical frame and is provided with various weights, and the weight change is not flexible. Therefore, there is strength training equipment that uses a motor to control the pulling force, the strength training equipment generally includes pedals, strength control portions located on the left and right sides of the pedals and pulling ropes connected with the strength control portions, and the strength control portions are mainly controlled by the motors. However, the motion mode of the existing strength training equipment is left-right separation, that is, each strength control portion is driven by an independent motor, two motors need to be arranged, the structure is complicated, and the cost is relatively high.

SUMMARY

In order to solve the technical problems that the motion mode of the strength training equipment in the prior art is left-right separation, the structure is complicated, and the cost is relatively high, the disclosure provides the strength training equipment.

In order to solve the technical problems, according to the technical solution of the disclosure, the strength training equipment is designed and includes a rack; and the strength training equipment further includes:

a speed changing device, which includes a driving motor arranged on the rack and a speed changer arranged on the rack and connected with the driving motor, wherein the speed changer outputs the output of the driving motor after speed reduction;

a differential mechanism, which is connected with the speed changer and provided with a first output shaft and a second output shaft and is able to convert the output after speed changing by the speed changer into asymmetric force to be output from the first output shaft and the second output shaft; and a take-up device, which includes a take-up box, wherein the take-up box includes a lower take-up box and an upper take-up box, and the two take-up boxes are connected with the first output shaft and the second output shaft respectively.

The speed changer includes a first reduction gear set connected with the driving motor and a second reduction gear set connected with the first reduction gear set.

The first reduction gear set includes:

a driving gear, which is fixed on an output shaft of the driving motor; and a first reduction gear, which is meshed with the driving gear;

the second reduction gear set includes:

a second main reduction gear;

a second slave reduction gear, which is meshed with the second main reduction gear; and the speed changer further includes a first reduction gear shaft, the two ends of the first reduction gear shaft are supported on the rack, the first reduction gear shaft is able to rotate relative to the rack, and the first reduction gear and the second main reduction gear are fixed to the first reduction gear shaft.

The first reduction gear and the second reduction gear are duplicate gears which are integrally formed and distributed up and down.

The differential mechanism includes:

a differential mechanism shell, which is connected with the rack and is able to rotate relative to the rack, wherein the second slave reduction gear sleeves the differential mechanism shell and is fixedly connected with the differential mechanism shell, and the first output shaft and the second output shaft are both rotatably connected with the differential mechanism shell;

a first differential gear, which is fixedly connected with the first output shaft;

a second differential gear, which is fixedly connected with the second output shaft;

a first planetary gear, which is engaged with the first differential gear; and a second planetary gear, which is engaged with the second differential gear and the first planetary gear; and the first planetary gear and the second planetary gear are able to rotate along with the differential mechanism shell, and the first planetary gear and the second planetary gear are also able to rotate relative to the differential mechanism shell.

The differential mechanism further includes:

a first planetary shaft, which is fixedly connected with the differential mechanism shell, wherein the first planetary gear sleeves the first planetary shaft and is able to rotate relative to the first planetary shaft; and a second planetary shaft, which is fixedly connected with the differential mechanism shell; and the second planetary gear sleeves the second planetary shaft and is able to rotate relative to the second planetary shaft.

The second output shaft is located over the first output shaft, the first differential gear is located at the upper end of the first output shaft, and the second differential gear is located at the lower end of the second output shaft. The first planetary shaft and the second planetary shaft are located on the sides of the first differential gear and the second differential gear; and a gap is formed between the first differential gear and the second differential gear, the height of the first planetary gear is lower than the lower surface of the second differential gear, and the height of the second differential gear is lower than the upper surface of the first planetary gear and higher than the upper surface of the first differential gear.

The differential mechanism further includes:

a differential shaft, which is rotatably connected with the first differential gear and the second differential gear, wherein the bottom of the differential shaft is fixedly connected with the bottom surface of the rack, and the top of the second output shaft is rotatably connected with the rack;

the differential mechanism shell includes:

a lower shell, wherein a first bearing is arranged in the center of the lower shell; the first bearing sleeves the first output shaft and is rotatably connected with the first output shaft and the lower shell; and an upper shell, wherein a second bearing is arranged in the center of the upper shell; the second bearing sleeves the second output shaft and is rotatably connected with the second output shaft and the upper shell; and the differential shaft is rotatably connected with the second differential gear, the first differential gear and the first output shaft sequentially through a third bearing, a fourth bearing and a fifth bearing from top to bottom.

The lower take-up box and the upper take-up box are arranged at the lower end and the upper end of the differential mechanism respectively, and the lower take-up box sleeves the first output shaft and is fixedly connected with the first output shaft; and the upper take-up box sleeves the second output shaft and is fixedly connected with the second output shaft.

The speed changing device, the differential mechanism and the take-up device are all located in the center of the rack, and the strength training equipment further includes pedal parts arranged on the left side and the right side of the rack.

According to the strength training equipment, the speed changing device, the differential mechanism and the take-up device are arranged, one driving motor and the speed changer are arranged in the speed changing device, and the speed changer outputs the output of the driving motor after speed reduction; the differential mechanism is connected with the speed changer and provided with the first output shaft and the second output shaft, and the differential mechanism can convert output after speed changing by the speed changer into asymmetric force to be output from the first output shaft and the second output shaft; the take-up device includes a take-up box, the take-up box includes the lower take-up box and the upper take-up box, and the two take-up boxes are connected with the first output shaft and the second output shaft respectively. Therefore, the output of one driving motor can be converted into two force outputs, the lower take-up box and the upper take-up box can be controlled, then the pulling force of the pulling ropes connected with the lower take-up box and the upper take-up box is controlled, and compared with the existing structure with two driving motors, the structure is simple, and the cost is low.

BRIEF DESCRIPTION OF DRAWINGS

The disclosure is described in detail according to the following embodiment and attached drawings.

DETAILED DESCRIPTION

The specific implementation mode of the disclosure is further stated in combination with the attached drawings.

Figure 1:
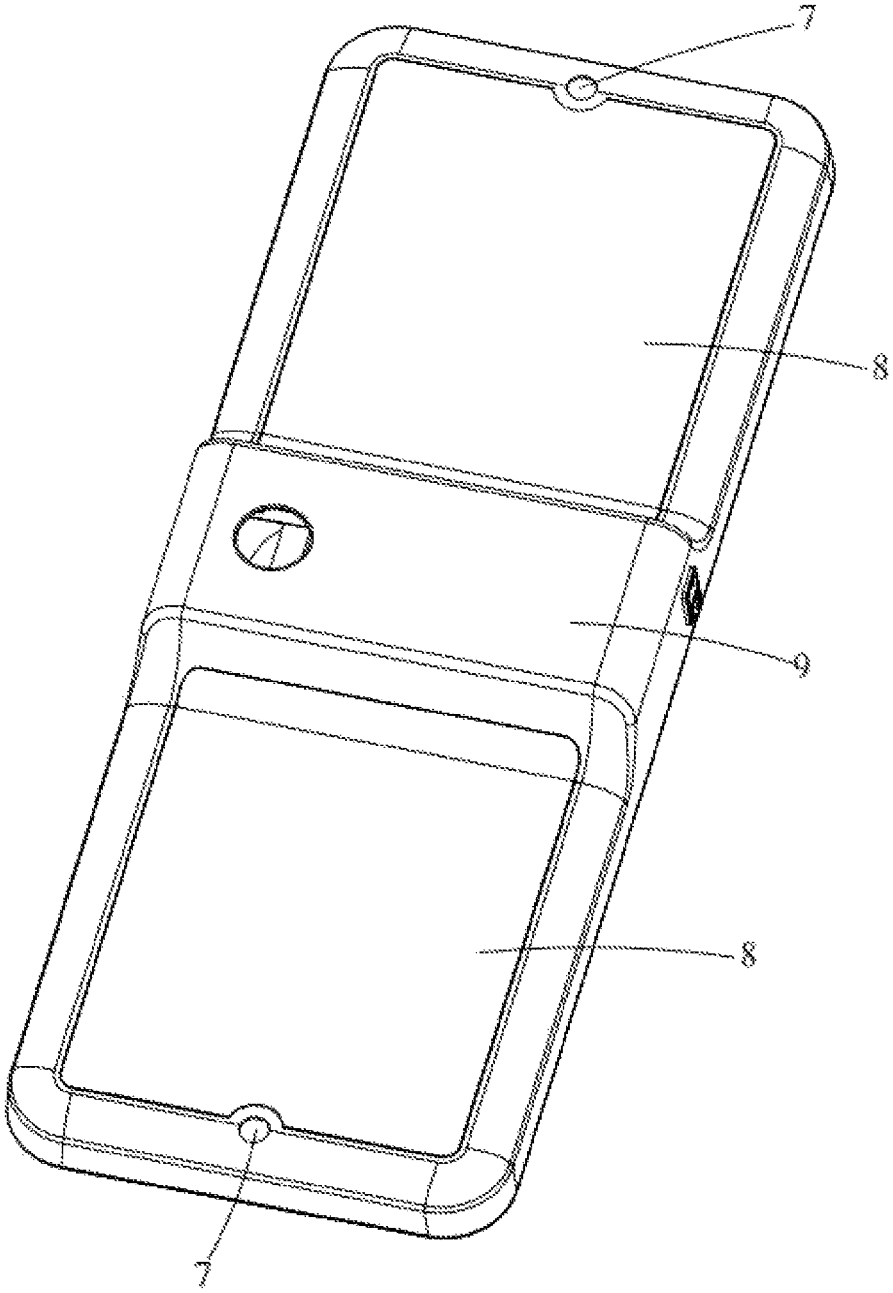
FIG. 1 is a structural diagram of the strength training equipment.
Figure 2:
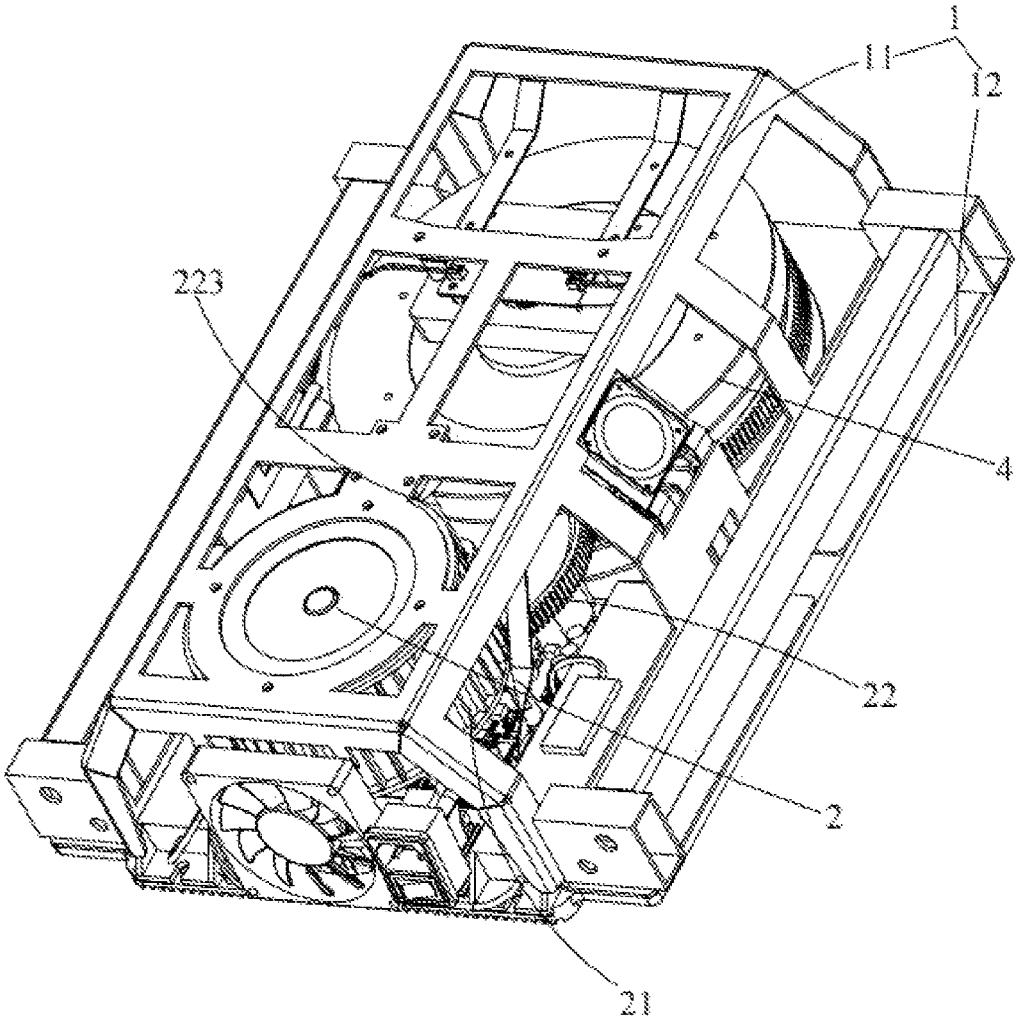
FIG. 2 is a structural diagram of the speed changing device, the differential mechanism and the take-up device of the strength training equipment.
Figure 3:
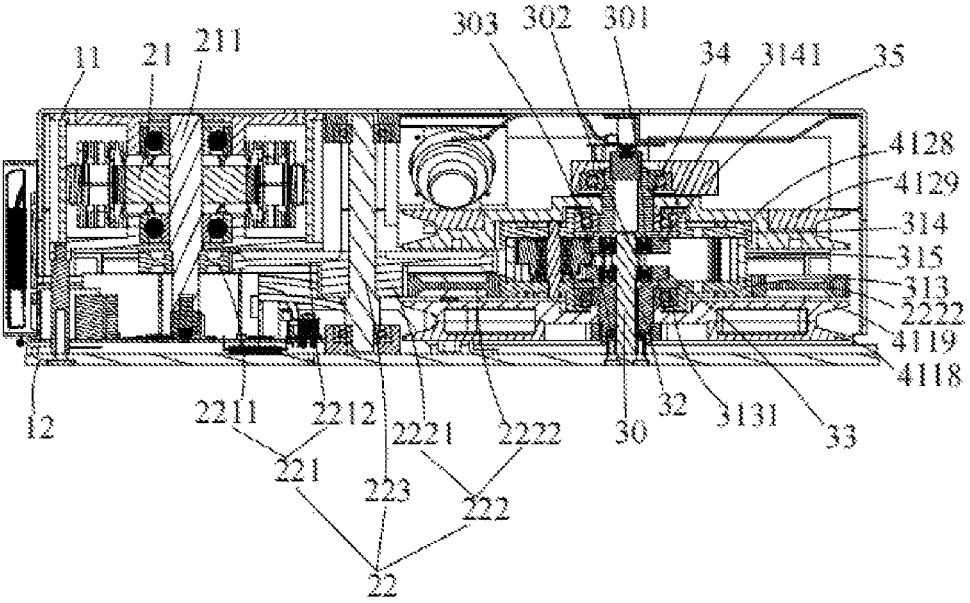
FIG. 3 is a cross-section diagram of FIG. 2.
Figure 4:
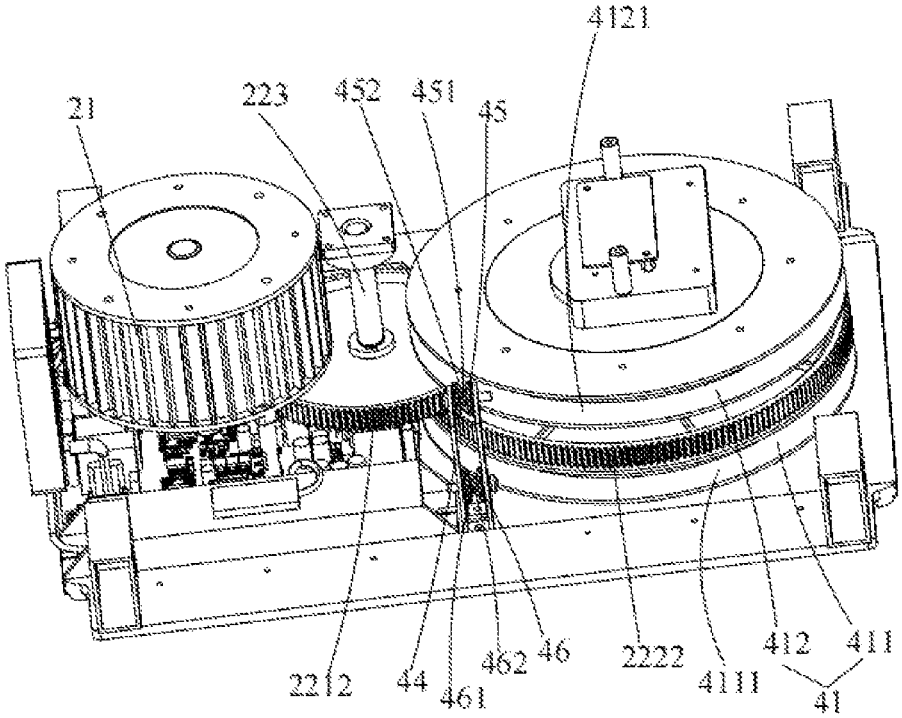
FIG. 4 is a structural diagram obtained after the upper rack is removed from FIG. 2.
Figure 5:
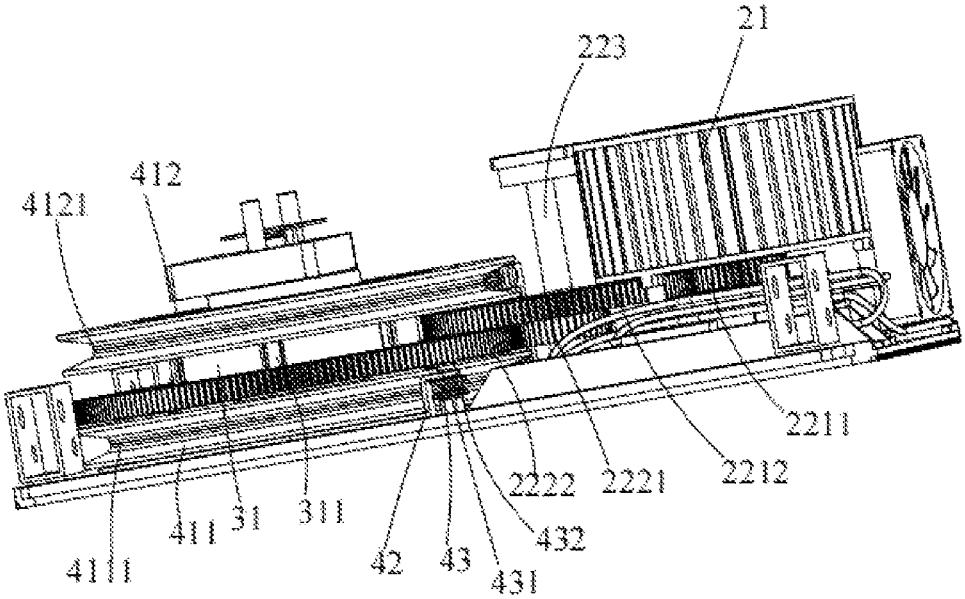
FIG. 5 is a structural diagram, from another view angle, obtained after the upper rack is removed from FIG. 2.
Figure 6:
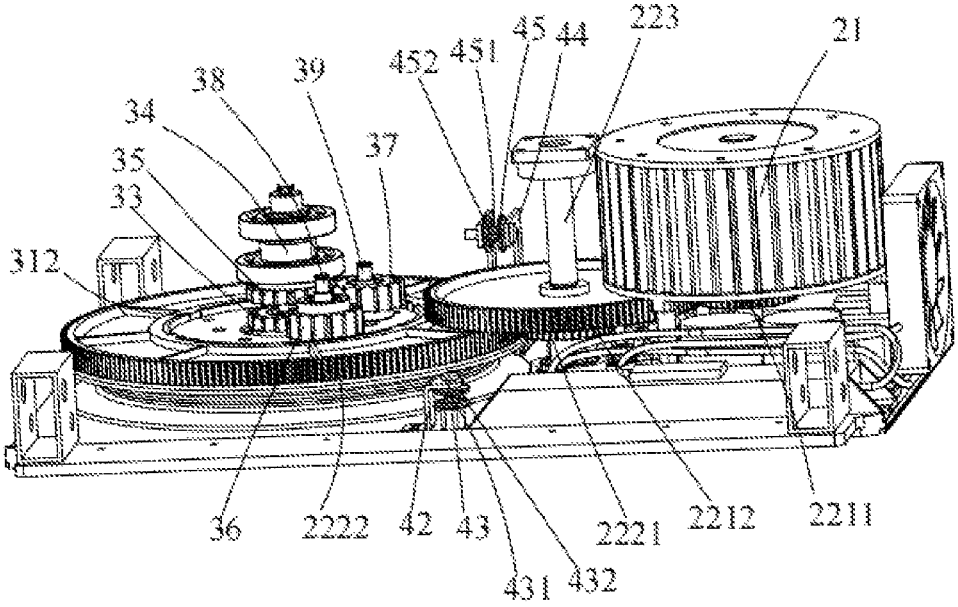
FIG. 6 is a structural diagram obtained after the upper take-up box and the upper shell of the differential mechanism are removed from FIG. 4.
Figure 7:
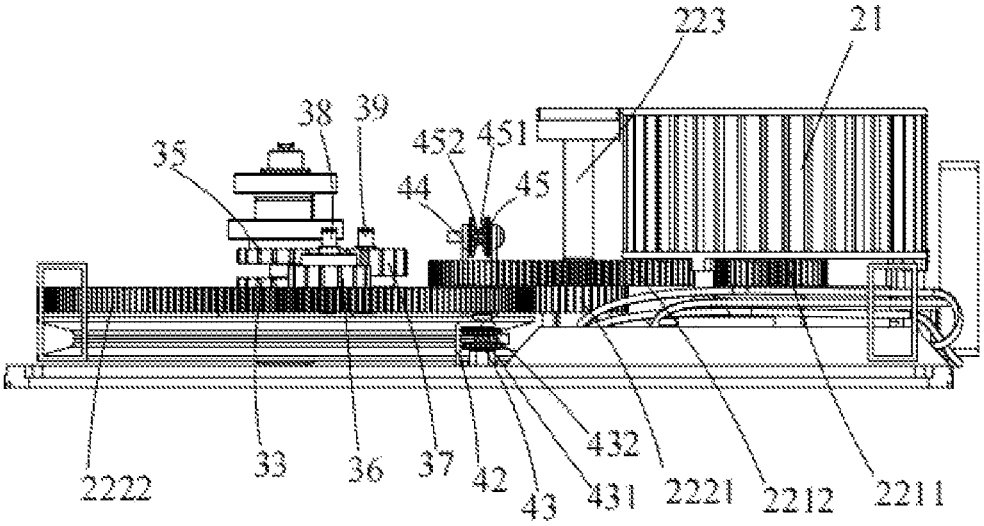
FIG. 7 is a main view of FIG. 6.
Figure 8:
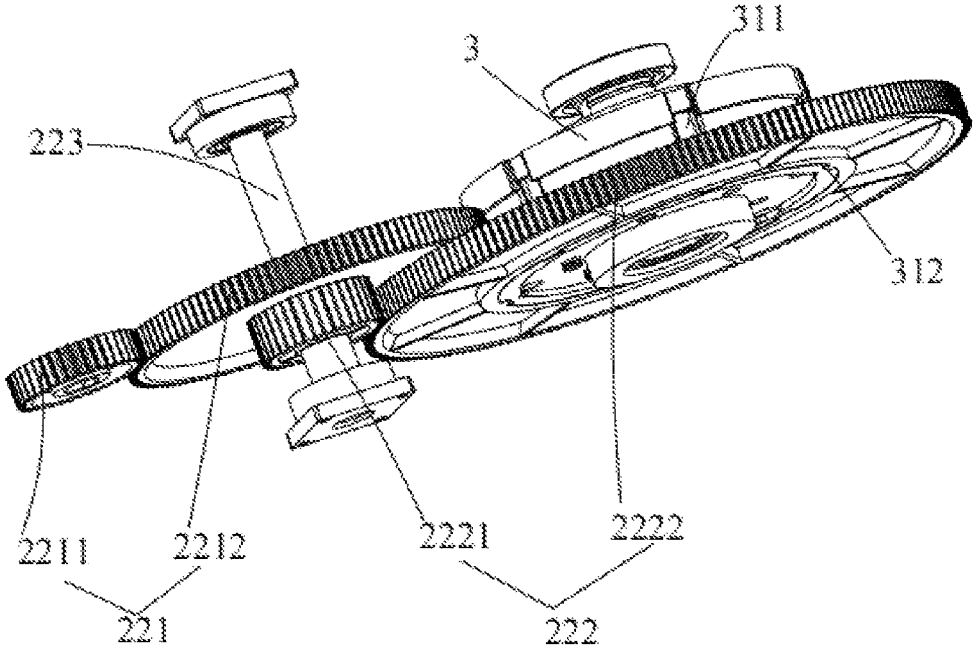
FIG. 8 is a stereogram of the speed changer.
Figure 9:
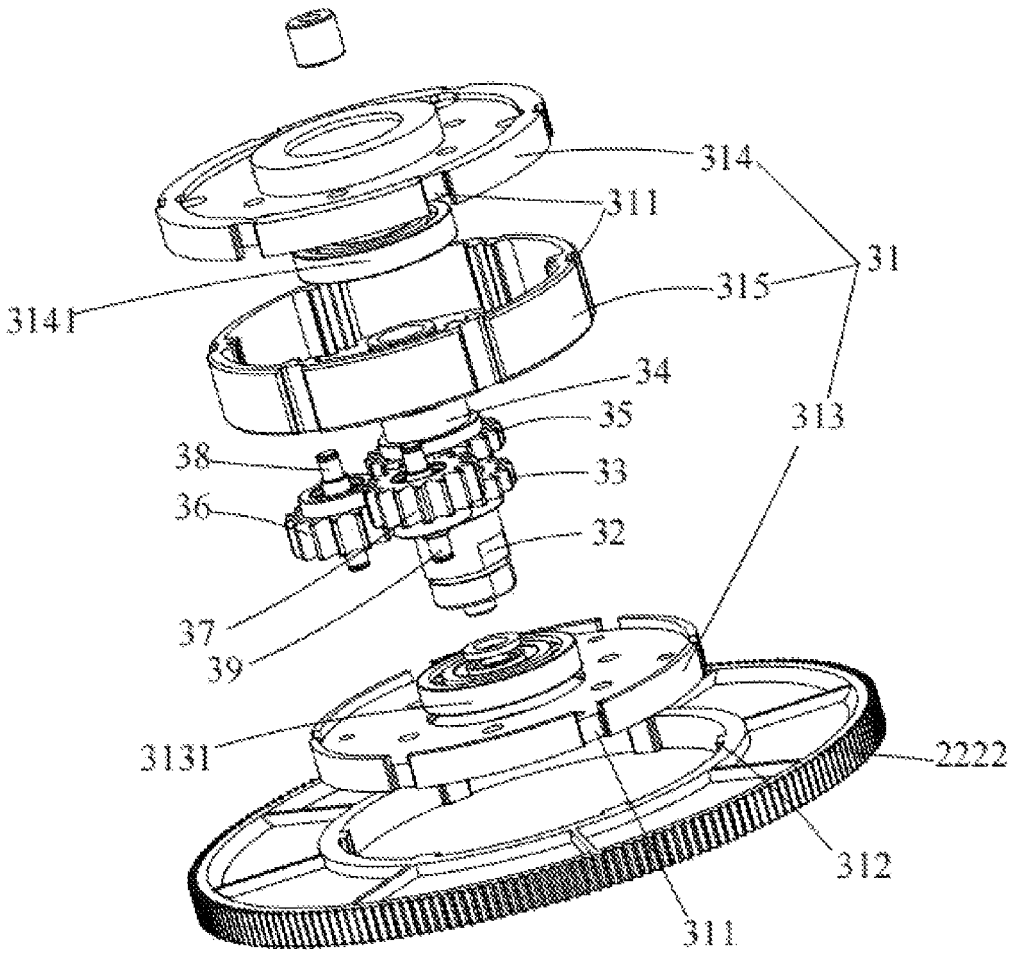
FIG. 9 is a decomposition diagram of the differential mechanism.
Figure 10:
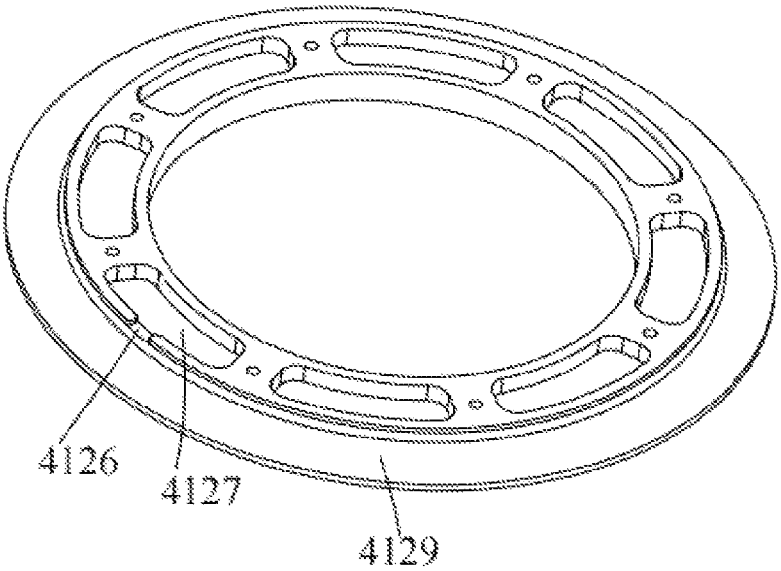
FIG. 10 is a structural diagram of the upper take-up box upper shell.
Figure 11:
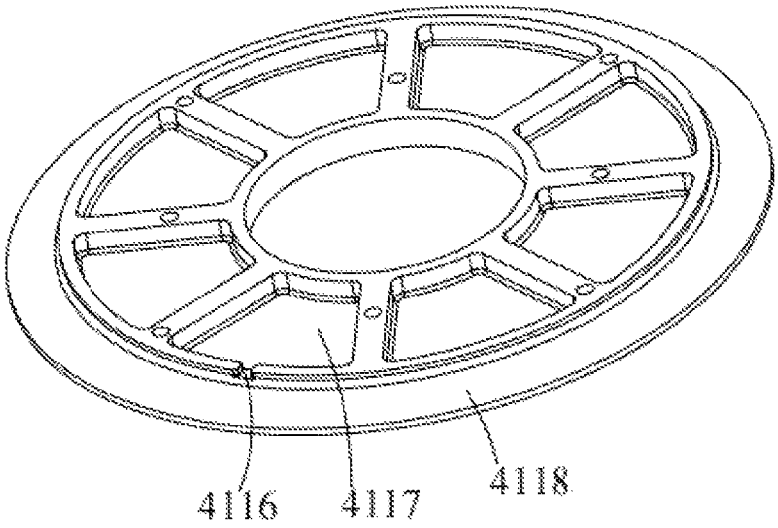
FIG. 11 is a structural diagram of the lower take-up box lower shell.

Please refer to FIG. 1 to FIG. 11. The strength training equipment includes a strength control portion 9, pedals 8 located on the two sides of the strength control portion 9 and pulling rope holes 7 formed in the outer sides of the pedals. The pulling rope is connected with the strength control portion 9 through the pulling rope hole 7, the pulling rope can be pulled by overcoming the force exerted on the pulling rope by the strength control portion, and therefore the purpose of strength training is achieved.

The strength control portion 9 includes a rack 1, a speed changing device 2, a differential mechanism 3 and a take-up device 4. Wherein:

The rack 1 includes an upper rack 11 and a lower rack 12.

The speed changing device 2 includes a driving motor 21 and a speed changer 22. The number of the driving motor is one, and the driving motor is arranged on the rack. The driving motor 21 is provided with a motor output shaft 211.

The speed changer 22 is arranged on the rack and connected with the driving motor, and the speed changer outputs the output of the driving motor after speed reduction. In the specific embodiment, the speed changer 22 includes a first reduction gear set 221 connected with the driving motor and a second reduction gear set 222 connected with the first reduction gear set, that is, the output of the driving motor is output after two times of speed reduction. The speed ratio of the first reduction gear set and the speed ratio of the second reduction gear set are both larger than 1 and smaller than 6.

The first reduction gear set 221 includes a driving gear 2211 and a first reduction gear 2212, wherein the driving gear 2211 is fixed on the output shaft of the driving motor. The first reduction gear 2212 is engaged with the drive gear.

The second reduction gear set 222 includes a second main reduction gear 2221 and a second slave reduction gear 2222. Wherein, the second slave reduction gear 2222 is meshed with the second main reduction gear. The second main speed reduction gear 2221 and the first speed reduction gear 2212 can be connected in a meshing mode, but the second main speed reduction gear and the second slave speed reduction gear are large in size and occupy large space due to the fact that the second main speed reduction gear 2221 and the first speed reduction gear 2212 are connected in the meshing mode. Therefore, in the specific embodiment, the speed changer further includes a first reduction gear shaft 223, the two ends of the first reduction gear shaft 223 are supported on the rack and can rotate relative to the rack, and the first reduction gear and the second main reduction gear are fixed to the first reduction gear shaft. Therefore, the second main reduction gear and the first reduction gear rotate synchronously, the size of the second main reduction gear can be made to be small, the structure is compact, and the occupied space is small. In the specific embodiment, the first reduction gear and the second main reduction gear are duplicate gears which are integrally formed and distributed up and down. The second main reduction gear is formed by extending downwards from the center of the first reduction gear, so that the manufacturing is simpler, and the structure is more compact.

In the specific embodiment, the two ends of the first reduction gear shaft are supported between the upper rack and the lower rack through bearings respectively, so that the first reduction gear shaft can rotate relative to the rack.

The driving gear, the first reduction gear, the second main reduction gear and the second slave reduction gear are arranged in the horizontal direction, and the driving gear, the first reduction gear, the second main reduction gear and the second slave reduction gear are straight-tooth gears. Due to the fact that the gears are straight-tooth gears, manufacturing is simpler, and installation is more convenient.

The diameter of the driving gear is smaller than that of the first reduction gear, and the diameter of the second main reduction gear is smaller than that of the first reduction gear and that of the second slave reduction gear. Specific parameters of the driving gear, the first reduction gear, the second main reduction gear and the second slave reduction gear can be selected according to actual needs.

Through the structural design of the driving gear, the first reduction gear, the second main reduction gear and the second slave reduction gear, the speed changing device is compact in structure, the space size needed is smaller than that of the existing belt-chain transmission, meanwhile, the transmission is more stable, and the transmission efficiency is higher.

By arranging the driving motor and the speed changer connected with the driving motor, the speed changer is used for outputting the output of the driving motor after speed reduction, and power is provided for the strength training equipment. The speed changer includes a first reduction gear set connected with the driving motor and a second reduction gear set connected with the first reduction gear set. The existing belt-chain transmission is changed into the gear transmission, and through two-stage gear transmission composed of the first reduction gear set and the second reduction gear set, the output of the motor can perfectly meet the requirement of the strength training equipment after being transmitted by the gear sets. The structure is compact, the occupied space is small, the transmission is stable, and the transmission efficiency is high.

The differential mechanism 3 is connected with the speed changer and provided with a first output shaft and a second output shaft, and the differential mechanism can convert the output after speed changing by the speed changer into asymmetric force to be output from the first output shaft and the second output shaft.

In the specific embodiment, the differential mechanism 3 includes a differential mechanism shell 31, a first output shaft 32, a second output shaft 33, a first differential gear 34, a second differential gear 35, a first planetary gear 36, a second planetary gear 37, a first planetary shaft 38, a second planetary shaft 39 and a differential shaft 30.

The differential mechanism shell 31 is connected with the rack and can rotate relative to the rack. The second slave reduction gear sleeves the differential mechanism shell and is fixedly connected with the differential mechanism shell. Concave clamping grooves 311 are formed in the outer side face of the differential mechanism shell 31. The second slave reduction gear 2222 is provided with clamping protrusions 312, and the clamping protrusions 312 are clamped in the clamping grooves 311 so that the second slave reduction gear can be fixedly connected with the differential mechanism shell.

The differential mechanism shell 31 includes a lower shell 313, an upper shell 314 and a middle shell 315 connecting the upper shell and the lower shell. A first bearing 3131 is arranged in the center of the lower shell 313, and a second bearing 3141 is arranged in the center of the upper shell 314. In the specific embodiment, the second slave reduction gear 2222 is clamped on the lower shell 313 of the differential mechanism.

The first output shaft 32 is rotatably connected to the differential mechanism shell. In the specific embodiment, the first bearing 3131 sleeves the first output shaft and is rotatably connected with the first output shaft and the lower shell.

The first differential gear 33 is fixedly connected with the first output shaft.

The second output shaft 34 is rotatably connected to the differential mechanism shell. In the specific embodiment, the second bearing sleeves the second output shaft and is rotatably connected with the second output shaft and the upper shell.

In the specific embodiment, the axis of the first output shaft and the axis of the second output shaft are located on the same line.

The second differential gear 35 is fixedly connected with the second output shaft.

The first planetary gear 36 meshes with the first differential gear.

The second planetary gear 37 meshes with the second differential gear and the first planetary gear.

The first planetary gear and the second planetary gear can rotate along with the differential mechanism shell, and meanwhile the first planetary gear and the second planetary gear can also rotate relative to the differential mechanism shell.

The first planetary shaft 38 is fixedly connected with the differential mechanism shell 31; the first planetary gear 36 sleeves the first planetary shaft 38 and can rotate relative to the first planetary shaft.

The second planetary shaft 39 is fixedly connected with the differential mechanism shell 31; and the second planetary gear 37 sleeves the second planetary shaft and can rotate relative to the second planetary shaft.

In the specific embodiment, the first planetary shaft 38 and the second planetary shaft 39 are parallel to the first output shaft 32 and the second output shaft 34, and the two ends of the first planetary shaft and the two ends of the second planetary shaft are fixed to the upper shell 314 and the lower shell 313 respectively.

The second output shaft 34 is located directly over the first output shaft 32, the first differential gear 33 is located at the upper end of the first output shaft 32, and the second differential gear 35 is located at the lower end of the second output shaft 34. The first planetary shaft 38 and the second planetary shaft 39 are located on the sides of the first differential gear 33 and the second differential gear 35.

A gap is formed between the first differential gear 33 and the second differential gear 35, the height of the first planetary gear is lower than the lower surface of the second differential gear, and the height of the second differential gear is lower than the upper surface of the first planetary gear and higher than the upper surface of the first differential gear. Therefore, the arrangement of the first differential gear, the second differential gear, the first planetary gear and the second planetary gear is more compact.

The differential shaft 30 is rotatably connected with the first differential gear 33 and the second differential gear 34, the bottom of the differential shaft is fixedly connected with the bottom face of the rack, and the top of the second output shaft 34 is rotatably connected with the rack. The differential shaft is matched with the second output shaft to play a role in supporting the differential mechanism.

The differential shaft 30 is rotatably connected with the second differential gear, the first differential gear and the first output shaft through a third bearing 301, a fourth bearing 302 and a fifth bearing 303 in sequence from top to bottom.

The first differential gear, the second differential gear, the first planetary gear and the second planetary gear are all straight-tooth gears, and the straight-tooth gear is convenient to manufacture and mount.

According to the working principle of the differential mechanism, when the first differential gear and the second differential gear rotate at the same rotating speed, the differential mechanism shell, the first differential gear and the second differential gear rotate at the same rotating speed, and the first planetary gear and the second planetary gear revolve along with the differential mechanism shell. When the rotating speeds of the first differential gear and the second differential gear are different, the differential mechanism shell rotates, the first planetary gear and the second planetary gear rotate while the first planetary gear and the second planetary gear revolve along with the differential mechanism shell, and therefore differential rotation between the first differential gear and the second differential gear is achieved.

According to the differential mechanism, the first output shaft, the first differential gear, the second output shaft, the second differential gear, the first planetary gear and the second planetary gear are arranged, and the first output shaft and the second output shaft are both rotatably connected with the differential mechanism shell; the first differential gear is fixedly connected with the first output shaft; the second differential gear is fixedly connected with the second output shaft; the first planetary gear is meshed with the first differential gear; the second planetary gear is meshed with the second differential gear and the first planetary gear; the first planetary gear and the second planetary gear can rotate along with the differential mechanism shell, and meanwhile the first planetary gear and the second planetary gear can also rotate relative to the differential mechanism shell. Therefore, the force transmitted to the differential mechanism shell through the single motor can be output through the first output shaft and the second output shaft, the strength training equipment can output two sets of force through the differential mechanism only by arranging one motor, the structure is more compact, the cost is lower, and the occupied space is smaller.

The differential mechanism is compact and simple in structure. The torque of the single motor is utilized, two sets of force are output through the differential mechanism, the space structure of the whole strength training equipment is optimized, and meanwhile the product manufacturing cost is reduced.

The driving gear on the main shaft of the driving motor outputs motor torsion, the motor torsion is transmitted to the differential mechanism shell of the differential mechanism through the speed changer, the first differential gear and the second differential gear receive two sets of pulling force transmitted by the external pulling ropes, and the two sets of pulling force and the torsion output by the driving motor form acting force and counter-acting force. Through the device action of the differential mechanism, the torsion output by the driving motor can output a set of asymmetric force, and the diversity during strength training is met.

The take-up device 4 includes a take-up box 41, the take-up box 41 includes a lower take-up box 411 and an upper take-up box 412, and the two take-up boxes are connected with the first output shaft and the second output shaft respectively. The lower take-up box and the upper take-up box are arranged at the lower end and the upper end of the differential mechanism respectively, the lower take-up box 411 sleeves the first output shaft 32 and is fixedly connected with the first output shaft, and the upper take-up box sleeves the second output shaft 34 and is fixedly connected with the second output shaft.

The upper take-up box and the lower take-up box are mainly used for being connected with the pulling ropes on the left side and the right side and taking up and paying off the pulling ropes.

A first winding groove 4111 which is concave inwards is formed in the side face of the lower take-up box 411, and a second winding groove 4121 which is concave inwards is formed in the side face of the upper take-up box 412. The first winding groove and the second winding groove are mainly used for accommodating the pulling ropes.

The lower take-up box 411 includes a lower take-up box upper shell 4119 and a lower take-up box lower shell 4118, and the lower take-up box lower shell 4118 is fixedly connected with the lower take-up box upper shell; and a first wire fixing gap 4117 and a first wire fixing groove 4116 communicating with the first wire fixing gap are formed between the lower take-up box upper shell and the lower take-up box lower shell.

The upper take-up box 412 includes an upper take-up box upper shell 4129 and an upper take-up box lower shell 4128, and the upper take-up box lower shell 4128 is fixedly connected with the upper take-up box upper shell; and a second wire fixing gap 4127 and a second wire fixing groove 4126 communicating with the second wire fixing gap are formed between the upper take-up box upper shell and the upper take-up box lower shell.

The first wire fixing groove and the second wire fixing groove are located in the first winding groove and the second winding groove respectively.

Through the arrangement of the first wire fixing gap, the first wire fixing groove, the second wire fixing gap and the second wire fixing groove, the end parts of the pulling ropes can be fixed on the lower take-up box and the upper take-up box, so that the pulling ropes can be conveniently taken up and paid off in the take-up boxes.

In the specific embodiment, the first wire fixing groove and the second wire fixing groove are respectively arranged on the lower take-up box upper shell and the upper take-up box lower shell.

In order to enable the take-up box to take up and pay off the pulling rope better, the take-up device further includes a first wire guide frame 42, a first wire guide wheel 43, a second wire guide frame 44 and a second wire guide wheel 45. Wherein:

The first wire guide frame 42 is arranged on the rack and is positioned on the side of the lower take-up box.

The first wire guide wheel 43 is arranged on the first wire guide frame and can rotate relative to the first wire guide frame; a first wire guide groove 431 is formed in the side face of the first wire guide wheel, the first wire guide wheel is arranged right opposite to the first winding groove, and the height of the first wire guide wheel is the same as that of the first winding groove.

The second wire guide frame 44 is arranged on the rack and is positioned on the side of the upper take-up box.

The second wire guide wheel 45 is arranged on the second wire guide frame and can rotate relative to the second wire guide frame; a second wire guide groove 451 is formed in the side face of the second wire guide wheel, the second wire guide wheel is arranged right opposite to the second winding groove, and the height of the second wire guide wheel is the same as that of the second winding groove.

Through the arrangement of the first wire guide wheel and the second wire guide wheel, when the ropes are pulled, the pulling ropes enter and exit in the horizontal direction of the first winding groove and the second winding groove, and the situation that the pulling ropes are separated from the first winding groove or the second winding groove due to the height difference is avoided.

In the specific embodiment, the first wire guide frame 42 and the second wire guide frame 44 are oppositely arranged on the left side and the right side of the take-up box, the first wire guide wheel is located on the tangent line of the first winding groove, and the second wire guide wheel is located on the tangent line of the second winding groove. Therefore, taking-up and paying-off of the pulling ropes are facilitated.

Furthermore, a third wire guide wheel 46 right opposite to the first wire guide wheel is arranged below the second wire guide frame 44, and a third wire guide groove 461 is formed in the third wire guide wheel. The third wire guide wheel is mainly used for conveniently leading down the pulling rope from the second wire guide wheel, so that running from the bottom is facilitated.

In order to prevent the pulling rope from falling off from the wire guide wheel, the first wire guide wheel 43 is further provided with a first anti-falling column 432 located between the two side faces of the first wire guide groove. The second wire guide wheel 45 is further provided with a second anti-falling column 452 located between the two side faces of the second wire guide groove. The second wire guide wheel 46 is further provided with a third anti-falling column 462 located between the two side faces of the third wire guide groove.

The upper take-up box and the lower take-up box are arranged at the upper end and the lower end of the differential mechanism respectively, and the structure is very compact. The first wire guide wheel, the second wire guide wheel and the third wire guide wheel are matched, so that running, taking-up and paying-off of the pulling ropes are facilitated.

The upper take-up box and the lower take-up box are arranged, the lower take-up box and the upper take-up box are arranged at the lower end and the upper end of the differential mechanism respectively, the differential mechanism is provided with the first output shaft and the second output shaft, and the lower take-up box sleeves the first output shaft and is fixedly connected with the first output shaft. The upper take-up box sleeves the second output shaft and is fixedly connected with the second output shaft. The take-up box and the differential mechanism are perfectly combined together, the structure is compact, and the upper take-up box and the lower take-up box are connected together through the differential mechanism.

According to the strength training equipment, the speed changing device, the differential mechanism and the take-up device are arranged, one driving motor and the speed changer are arranged in the speed changing device, and the speed changer outputs the output of the driving motor after speed reduction; the differential mechanism is connected with the speed changer and provided with a first output shaft and a second output shaft, and the differential mechanism can convert the output after speed changing by the speed changer into asymmetric force to be output from the first output shaft and the second output shaft; the take-up device includes a take-up box, the take-up box includes the lower take-up box and the upper take-up box, and the two take-up boxes are connected with the first output shaft and the second output shaft respectively. Therefore, the output of one driving motor can be converted into two force outputs, the lower take-up box and the upper take-up box can be controlled, then the pulling force of the pulling ropes connected with the lower take-up box and the upper take-up box is controlled, and compared with the existing equipment with two driving motors, the structure is simple, and the cost is low.

The above is only a better embodiment of the disclosure, and is not intended to limit the disclosure, and any modification, equivalent replacement, improvement and the like made within the spirit and principle of the disclosure should be included in the protection range of the disclosure.

What is claimed is:

1. A strength training equipment, comprising a rack, and further comprising:

a speed changing device, which comprises a driving motor arranged on the rack and a speed changer arranged on the rack and connected with the driving motor, wherein the speed changer outputs an output of the driving motor after speed reduction;

a differential, which is connected with the speed changer and provided with a first output shaft and a second output shaft and is able to convert the output after speed changing by the speed changer into asymmetric force to be output from the first output shaft and the second output shaft; and a take-up device, which comprises a take-up box, wherein the take-up box comprises a lower take-up box and an upper take-up box, wherein the lower take-up box is connected with the first output shaft, and the upper take-up box is connected with the second output shaft.

2. The strength training equipment according to claim 1, wherein the speed changer comprises a first reduction gear set connected with the driving motor and a second reduction gear set connected with the first reduction gear set.

3. The strength training equipment according to claim 2, wherein the first reduction gear set comprises:

a driving gear, which is fixed on an output shaft of the driving motor; and a first reduction gear, which is meshed with the driving gear;

the second reduction gear set comprises:

a second main reduction gear;

a second slave reduction gear, which is meshed with the second main reduction gear; and the speed changer further comprises a first reduction gear shaft, two ends of the first reduction gear shaft are supported on the rack, the first reduction gear shaft is able to rotate relative to the rack, and the first reduction gear and the second main reduction gear are fixed to the first reduction gear shaft.

4. The strength training equipment according to claim 3, wherein the first reduction gear and the second main reduction gear are duplicate gears which are integrally formed and distributed up and down.

5. The strength training equipment according to claim 3, wherein the differential comprises:

a differential shell, which is connected with the rack and is able to rotate relative to the rack, wherein the second slave reduction gear sleeves the differential shell and is fixedly connected with the differential shell, and the first output shaft and the second output shaft are both rotatably connected with the differential shell;

a first differential gear, which is fixedly connected with the first output shaft;

a second differential gear, which is fixedly connected with the second output shaft;

a first planetary gear, which is engaged with the first differential gear; and a second planetary gear, which is engaged with the second differential gear and the first planetary gear; and the first planetary gear and the second planetary gear are able to rotate along with the differential shell, and the first planetary gear and the second planetary gear are also able to rotate relative to the differential shell.

6. The strength training equipment according to claim 5, wherein the differential further comprises:

a first planetary shaft, which is fixedly connected with the differential shell, wherein the first planetary gear sleeves the first planetary shaft and is able to rotate relative to the first planetary shaft; and a second planetary shaft, which is fixedly connected with the differential shell; and the second planetary gear sleeves the second planetary shaft and is able to rotate relative to the second planetary shaft.

7. The strength training equipment according to claim 6, wherein the second output shaft is located directly over the first output shaft, the first differential gear is located at an upper end of the first output shaft, and the second differential gear is located at a lower end of the second output shaft; the first planetary shaft and the second planetary shaft are located on sides of the first differential gear and the second differential gear; and a gap is formed between the first differential gear and the second differential gear, a height of the first planetary gear is lower than a lower surface of the second differential gear, and a height of the second differential gear is lower than an upper surface of the first planetary gear and higher than an upper surface of the first differential gear.

8. The strength training equipment according to claim 7, wherein the differential further comprises:

a differential shaft, which is rotatably connected with the first differential gear and the second differential gear, wherein a bottom of the differential shaft is fixedly connected with a bottom surface of the rack, and a top of the second output shaft is rotatably connected with the rack;

the differential shell comprises:

a lower shell, wherein a first bearing is arranged in a center of the lower shell; the first bearing sleeves the first output shaft and is rotatably connected with the first output shaft and the lower shell; and an upper shell, wherein a second bearing is arranged in a center of the upper shell; the second bearing sleeves the second output shaft and is rotatably connected with the second output shaft and the upper shell; and the differential shaft is rotatably connected with the second differential gear, the first differential gear and the first output shaft sequentially through a third bearing, a fourth bearing and a fifth bearing from top to bottom.

9. The strength training equipment according to claim 1, wherein the lower take-up box is arranged at a lower end of the differential, and the upper take-up box is arranged at an upper end of the differential, and the lower take-up box sleeves the first output shaft and is fixedly connected with the first output shaft; and the upper take-up box sleeves the second output shaft and is fixedly connected with the second output shaft.

10. The strength training equipment according to claim 1, wherein the speed changer, the differential and the take-up device are all located in A center of the rack, and the strength training equipment further comprises pedal parts arranged on a left side and a right side of the rack.

* * * * *